United States Patent [19]

Kennedy et al.

[11] Patent Number: 4,493,671

[45] Date of Patent: Jan. 15, 1985

[54] TOY VEHICLE HAVING SPRING-OPERATED MOTOR

[75] Inventors: Melvin R. Kennedy, New York, N.Y.; Dietmar Nagel, Chester, N.J.; Avi Arad, Westport, Conn.

[73] Assignee: Buddy L Corporation, New York, N.Y.

[21] Appl. No.: 260,588

[22] Filed: May 6, 1981

[51] Int. Cl.[3] ..... A63H 29/00

[52] U.S. Cl. ..... 446/464

[58] Field of Search ..... 46/206, 207, 208, 209, 46/201, 202, 222

[56] References Cited

U.S. PATENT DOCUMENTS

| | | | |
|---|---|---|---|
| 3,653,149 | 4/1972 | Prodger et al. | 46/222 X |
| 3,768,835 | 10/1973 | Lee | 46/208 X |
| 3,919,804 | 11/1975 | Nakata | 46/206 |
| 4,241,534 | 12/1980 | Larsson et al. | 46/206 |

FOREIGN PATENT DOCUMENTS

| | | | |
|---|---|---|---|
| 578767 | 6/1933 | Fed. Rep. of Germany | 46/206 |
| 1003108 | 2/1957 | Fed. Rep. of Germany | 46/206 |

*Primary Examiner*—M. Yu

*Attorney, Agent, or Firm*—Michael Ebert

[57] ABSTRACT

A toy vehicle having a spring-operated clockworks motor which is charged by a pumping action, the vehicle having a chassis on whose front and rear ends are supported front and rear wheel axles, and a body resting on the chassis. The front of the body is hinged to the front end of the chassis, a stop being provided whereby the back of the body is liftable with respect to the rear end of the chassis within fixed limits. The clockworks motor, which includes a spiral spring, is mounted on the chassis and is operatively coupled to the rear wheel axle, the motor having a spring-biased crank arm which engages the underside of the body and acts to normally raise the back thereof to its upper limit. The crank arm is operatively coupled to the spiral spring whereby by repeatedly depressing the back of the pivoted body while holding the vehicle to prevent rotation of the rear wheels, the crank is reciprocated to produce a rotary motion to wind the spring and thereby charge the motor. The charged motor acts to propel the vehicle when it is released.

10 Claims, 7 Drawing Figures

Fig. 5.
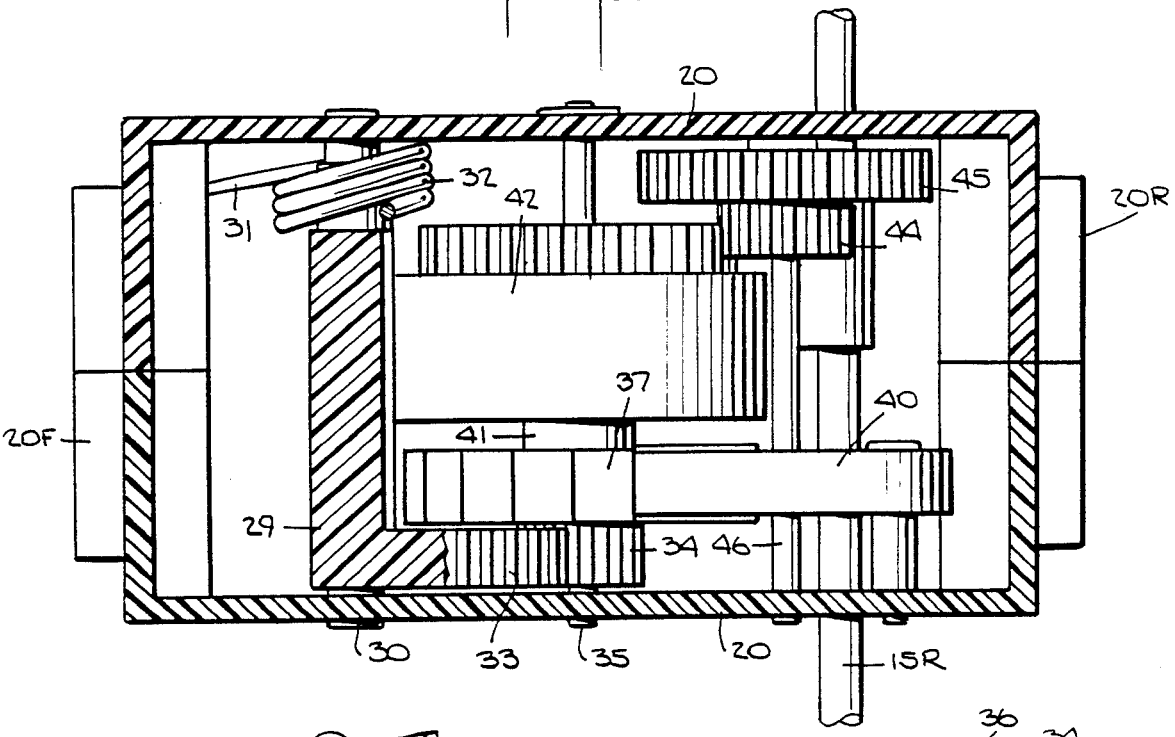
Fig. 6.
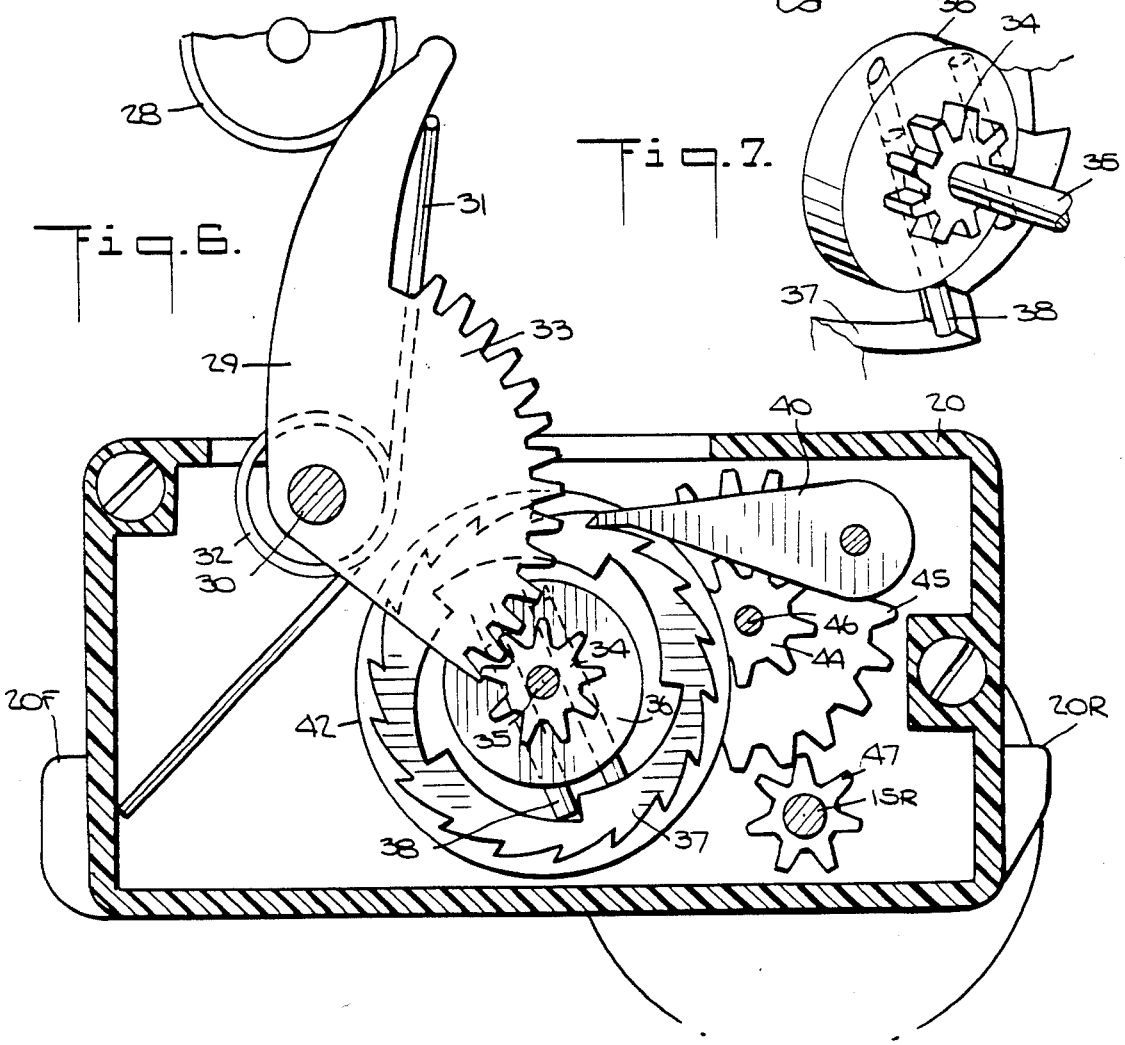
Fig. 7.

TOY VEHICLE HAVING SPRING-OPERATED MOTOR

BACKGROUND OF INVENTION

This invention relates generally to toy vehicles operated by a clockworks motor, and more particularly to a vehicle of this type in which the motor spring is charged by a pumping action.

Toy vehicles are known, such as those disclosed in the Cookson U.S. Pat. No. 2,057,557 and in the Lohn U.S. Pat. No. 2,587,052, which are operated by a clockworks-type motor, the motor including a spiral spring whose inner end is connected to a rotary shaft and whose outer end is coupled via transmission gears to the drive wheels of the vehicle. Also provided is a wind-up key which turns the spring shaft to wind the spring so that it stores the required energy, the drive wheels being arrested during winding to prevent an immediate discharge of the stored energy.

The term clockworks motor, as used herein, is not intended to apply to a motor having gears operated by a spring to drive the hands of a clock, but to a similar mechanism whose gears provide a transmission link between the spring and the driven wheels of the vehicle.

One drawback of a vehicle having a clockworks motor with a wind-up key is that very small children may not understand the function of the key or may lack sufficient strength or coordination to turn the key. To overcome this drawback, toy vehicles have been developed which do not require a key. Wind-up is effected, as in the Higashi U.S. Pat. No. 3,798,831 and the Darda U.S. Pat. No. 3,981,089, by means of a friction wheel which rolls on the ground surface and is operatively coupled to the spring shaft.

By pressing the vehicle on the ground and moving it along the surface, the friction wheel turns to wind the spring. When the vehicle is thereafter released, the tensioned spring of the motor then unwinds to propel the vehicle through the transmission gears.

A disadvantage of the typical toy vehicle whose spring motor is charged by turning a friction wheel is that winding only takes place when the vehicle engages and moves over the ground surface in a given direction. This presupposes that a child playing with this toy appreciates the fact that the motor can be charged by moving the vehicle in one direction only. But the reality is that small children may lack this understanding and often try to wind up the motor by moving the vehicle back and forth or in the wrong direction.

Also, with friction wheel-operated spring motors, when the floor on which the vehicle to be played is slippery, one must press fairly hard on the vehicle to be sure the friction wheel is engaged thereby and turns when moving the vehicle across the floor. Some children are incapable of applying the pressure necessary for this purpose.

Another drawback of friction wheel wind-up arrangements is that one cannot wind up the spring adequately, except by moving the vehicle a fair distance. When children are playing a racing game, they cannot, with such vehicles, wind up their spring motors at a common starting point.

SUMMARY OF INVENTION

In view of the foregoing, the main object of this invention is provide a toy vehicle having a spring-operated clockworks motor which is charged by a simple pumping action, thereby obviating the need for a wind-up key or a friction wheel, as in prior vehicles of this type.

More particularly, an object of this invention is to provide a toy vehicle of the above-noted type whose body is hinged to the front end of the chassis whereby the back of the body is normally raised above the chassis, the pumping action for charging the motor being effected by repeatedly depressing the body.

A significant advantage of a pumping-action vehicle of the above type is that a very young child, without special instruction is capable of fully charging the motor, very little strength being required for this purpose; for the child is able to use the weight of his body rather than muscular strength to effect the pumping action. In a key-wound motor, it becomes increasingly difficult to turn the key as the spring is tensioned and many children are unable to fully wind the spring.

Another advantage of the invention is that the motor is charged without the need to move the vehicle; and the more the motor is "revved" up by repeated pumping, the faster it will go when the vehicle is released. Hence two children at the same starting point may race their vehicles. Thus a pump-action vehicle in accordance with the invention has greater play value than known forms of spring-operated toy vehicles.

Also an object of the invention is to provide a toy vehicle of the above type which is of relatively uncomplicated, inexpensive and trouble-free mechanical design and which is capable of withstanding manhandling on the part of children.

Briefly stated, these objects are accomplished in a toy vehicle having a spring-operated clockworks motor which is charged by a pumping action, the vehicle comprising a chassis on whose front and rear ends are supported front and rear wheel axles, and a body resting on the chassis. The front of the body is hinged to the front end of the chassis, a stop being provided whereby the back of the body is liftable with respect to the rear end of the chassis within fixed limits.

The clockworks motor, which includes a spiral spring, is mounted on the chassis and is operatively coupled to the rear wheel axle, the motor having a spring-biased crank arm which engages the underside of the pivoted body and acts to normally raise the back thereof to its upper limit. The crank arm is operatively coupled through a ratchet mechanism to the spiral spring whereby by repeatedly depressing the back of the pivoted body while holding the vehicle to prevent rotation of the rear wheels, the crank is reciprocated to produce a rotary motion to wind the spring and charge the motor, the motor acting to propel the vehicle when it is released.

OUTLINE OF DRAWINGS

For a better understanding of the invention as well as other objects and further features thereof, reference is made to the following detailed description to be read in conjunction with the accompanying drawings, wherein:

FIG. 5 is a plan view of the clockworks motor;

FIG. 6 is a side view of the clockworks motor; and

FIG. 7 is a perspective of the one-way drive mechanism for coupling the crank-arm to the motor spring.

DESCRIPTION OF INVENTION

Figure 1:
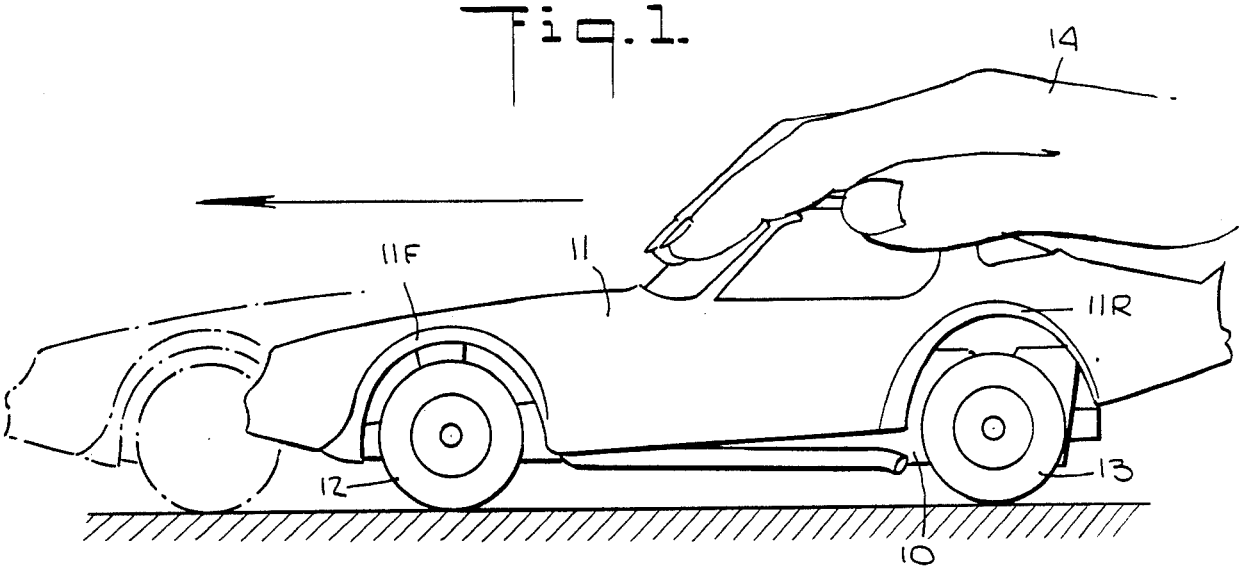
FIG. 1 illustrates, in perspective, a toy vehicle in accordance with the invention which is charged by a pumping action.

Referring now to the drawings, it will be seen in FIG. 1 that a toy vehicle in accordance with the invention includes a chassis 10 having front wheels 12 and rear wheels 13 supported thereon. Resting on the chassis is a car body 11 having the usual front hood, passenger cabin and rear trunk, the front of the body being hinged to the front end of the chassis. In practice, both the chassis and body may be molded of synthetic plastic material. The body is under spring tension so that the body rear is raised somewhat with respect to the rear end of the chassis. The car body included front and rear arcuate cut-outs 11F and 11R to accommodate the wheels.

By placing a hand 14 over the roof of the body and repeatedly pressing down, a pumping action is effected which acts to wind up and charge a clockworks motor seated on the chassis and operatively coupled to rear wheels 13. When the motor is fully charged and the hand is then removed to release the vehicle, the charged motor then acts to propel the vehicle in the forward direction as indicated by the arrow.

Figure 2:
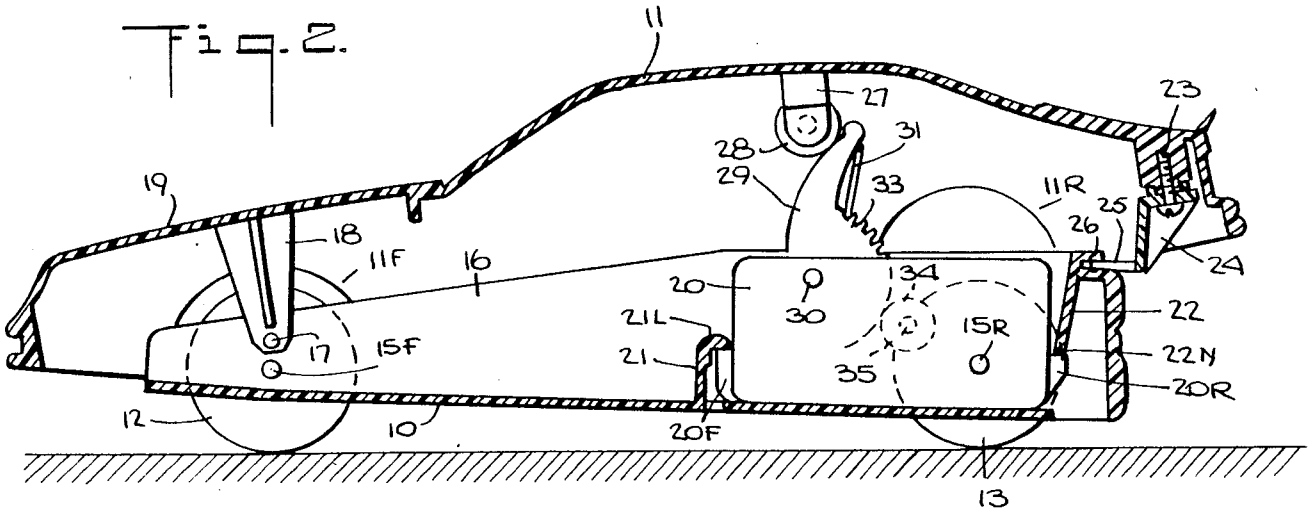
FIG. 2 is a longitudinal section taken through the vehicle which is shown with its hinged body raised.
Figure 3:
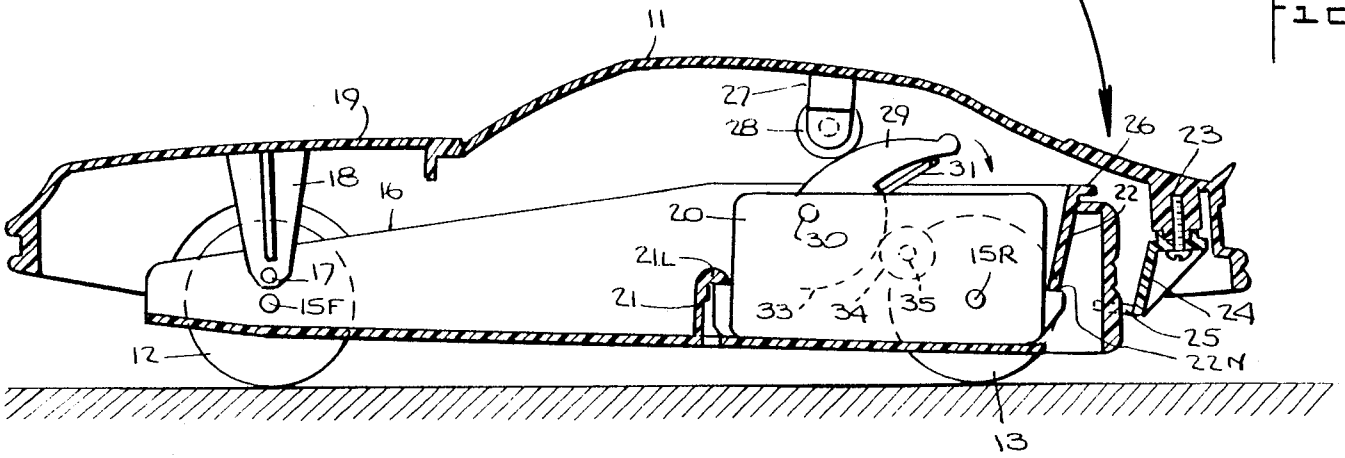
FIG. 3 is the same as FIG. 2, except that the hinged body is depressed to effect a pumping action.

As best seen in FIGS. 2 and 3, front wheels 12 are secured to the ends of a front axle 15F journaled in the side walls 16 of the chassis. A pivot rod 17 also held in the side walls 16 just above front axle 15F passes through bores at the extremities of bracket arms 18 which depend from hood 19 of the car body, thereby hingedly connecting the front of the body to the front end of the chassis.

Figure 4:
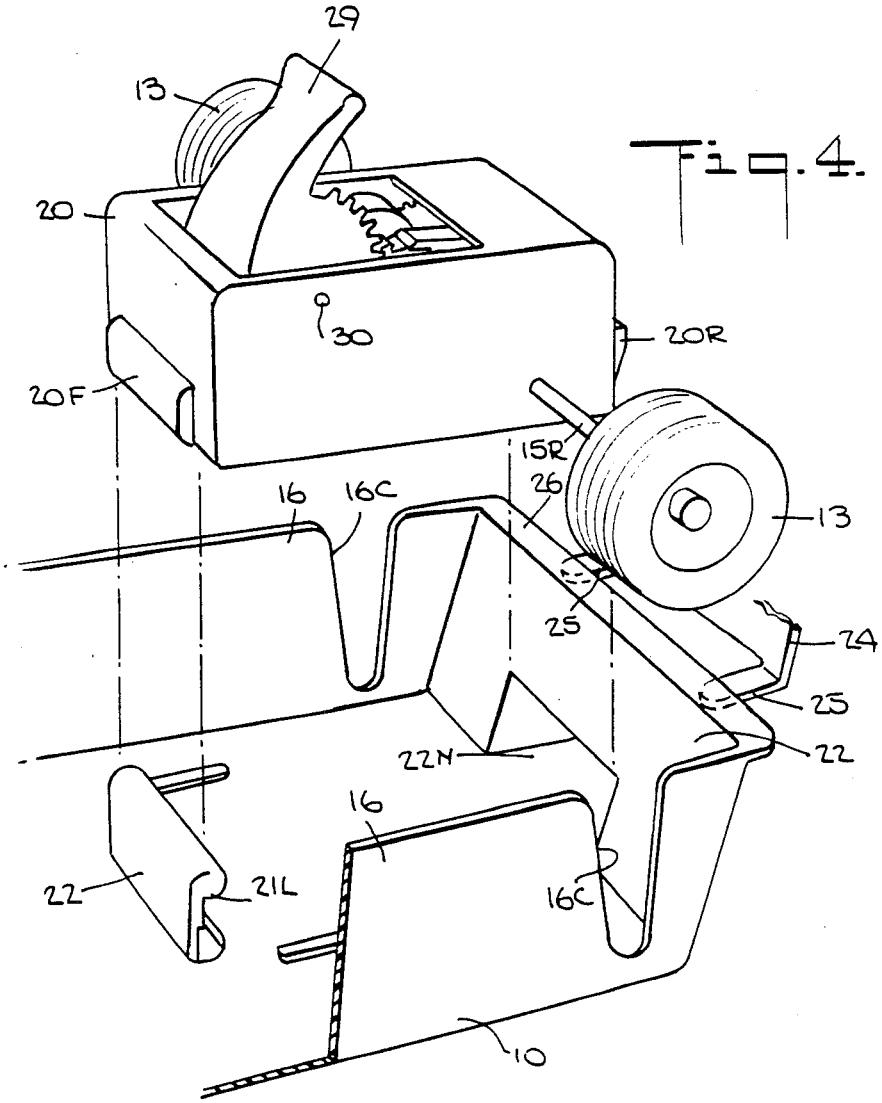
FIG. 4 illustrates, in perspective, the manner in which the clockworks motor is seated on the chassis of the vehicle.

The clockworks motor, as best seen in FIG. 4, is housed within a box-like case 20 having front and rear projections 20F and 20R on the front and rear walls of the case adjacent the bottom thereof. To install the motor on the floor of the chassis, front projection 20F is first placed under the top ledge 21L of an upright 21 integral with the floor, case 20 then being pushed down against the floor so that the rear projection slides down the flexible rear wall 22 of the chassis and then snaps into a notch 22N therein, thereby locking the motor in place. Side walls 16 of the chassis have cut-outs 16C therein to accommodate the rear wheel axle 15R which extends from either side of case 20. Thus the rear wheels and their axle are joined to the motor.

As shown in FIGS. 2 and 3, secured by screws 23 received in suitable threaded sockets on the underside of the body at the rear thereof is a stop member 24, having a pair of projecting fingers 25 (see FIG. 4). These fingers, when the body is raised above the rear end of the chassis, engage the underside of a rear end ledge 26 which acts as a limit to prevent further upward movement. Thus FIG. 2 shows fingers 25 in engagement with ledge 26, while FIG. 3 illustrates the body in the depressed state, fingers 25 then being disengaged from ledge 26.

Secured to the underside of the body roof, as best seen in FIGS. 2 and 3, is a bearing fixture 27 supporting a rotatable drum wheel 28 which engages the cammed outer edge of crank arm 29. Arm 29 is pivotally mounted on a shaft 30 whose ends are journaled in the sides of motor case 20. Crank arm 29 is normally held at its erect position by the extension wire 31 of a helical spring 32 mounded on crankshaft 30 (see FIG. 5) thereby lifting the pivoted car body to cause it to assume its maximum raised position, as in FIG. 1.

When the car body is depressed by the operator, the downwardly-moving wheel 28 rides along the cammed edge of crank arm 29, as shown in FIG. 3, and causes the arm to swing down, this action serving to effect winding of the clockworks motor.

Integral with the inner edge of crank arm 29 is a gear segment 33 which is positioned to intermesh with a pinion 34 mounted on an axle 35 whose ends are journaled in the sides of motor case 20 so that when the crank arm is pumped, axle 35 is caused to turn in a direction depending on whether the arm is going up or down. On the same axle adjacent pinion 34 is a drum 36 which is coaxially positioned within an annular ratchet 37 whose inner teeth are engaged by a pin 38 projecting from the drum, so that when axle 35 turns in the counterclockwise direction, pin 38 engages the ratchet teeth to cause the ratchet to turn in the same direction. Clockwise movement of the ratchet wheel is prevented by a pawl 40 which engages the outer teeth on the ratchet.

Thus an up and down pumping action of the crank arm causes the ratchet to turn only in the counterclockwise direction to wind a spiral spring whose inner end is coupled to the ratchet by a sleeve 41, the spring being contained within a cylindrical housing 42. The outer end of the spiral spring is coupled to a drive gear 43 which meshes with the pinion 44 of a transmission gear 45 mounted on a shaft 46. Transmission gear 45 meshes with a gear 47 on rear wheel axle 15R.

Thus the operator, by repeatedly depressing the car body, acts to pump crank arm 29 up and down, thereby winding the spring of the clockworks motor through a one-way drive mechanism. Because the rear car wheels, during this action, are prevented from turning, in that the car is pressed to the ground by the hand of the operator, unwinding of the spring is arrested during wind-up. But when the hand is removed, the car is free to move, and the charged motor then acts through its transmission gears to turn the rear wheels to propel the vehicle.

The invention is not limited to the particular clockworks motor shown, for any spring motor of the type which can be wound by a key or a friction wheel, can be adapted to be wound by a crank arm which is arranged and pumped in the manner disclosed herein. Nor is it necessary that the spring which biases the crank arm be included in the motor case, for the crank arm could be coupled to a spring-biased lingage external to the motor, the linkage engaging the roof of the car body to effect a pumping action.

While there has been shown and described a preferred embodiment of a Toy Vehicle Having a Spring-operated Motor in accordance with the invention, it will be appreciated that many changes and modifications may be made therein without, however, departing from the essential spirit thereof.

I claim:

1. A toy vehicle whose spring-operated motor requires little strength to fully charge, said vehicle comprising:

A. a chassis supporting front and rear wheels;

B. a car body resting on the chassis, the front of the body being hingedly connected on a pivot axis to the front end of the chassis whereby the rear thereof is raisable with respect to the rear end of the chassis within predetermined upper and lower limits, said body having a stop attached thereto having fingers which engage a ledge projecting from the rear wall of the chassis to define said upper limit;

C. a spring-operated motor seated on the chassis and concealed by the body, said motor having a spiral spring coupled by a transmission to said rear wheels;

D. a pivotally-mounted crank arm operatively coupled to the underside of the roof of the car body at a point intermediate the front and rear wheels and spring-biased to normally hold the arm erect to maintain the body at its upper limit, whereby when the body is repeatedly depressed manually by a hand grasping the body near the rear thereof, the hinged body is caused to swing about its pivot axis and the crank arm undergoes a pumping action; and E. means coupling said crank arm to the inner end of the spiral spring to effect winding thereof each time the arm is pumped.

2. A vehicle as set forth in claim 1, wherein said chassis is provided with side walls, and said front wheels are secured to the ends of an axle journaled in said side walls.

3. A vehicle as set forth in claim 2, wherein said body has bracket arms depending therefrom which are pivoted from a shaft extending between the side walls of the chassis to hinge the body from the chassis.

4. A vehicle as set forth in claim 2, wherein said motor is housed in a box-like case secured to the floor of the chassis, said rear wheels being mounted at the ends of an axle journaled in the side walls of the case and extending therefrom through cut-outs in the side walls of the chassis.

5. A vehicle as set forth in claim 1, wherein the outer edge of the crank arm has a cam surface which is engaged by a drum wheel supported on a bearing fixture secured to the underside of the roof of the car body, whereby when the body is depressed, the drum wheel rides down the cam surface to swing the crank arm.

6. A vehicle as set forth in claim 5, wherein said crank arm is pivoted on a shaft and is spring-biased by a helical spring mounted on said arm shaft and having an extension engaging the arm.

7. A vehicle as set forth in claim 6, wherein said arm is provided at its inner edge with a gear segment which inter meshes with a shaft-mounted pinion, whereby when the arm is pumped, said pinion is alternately turned in the clockwise and counterclockwise directions, and a one-way drive mechanism to couple said pinion to the inner end of the spiral spring to effect winding thereof only when the pinion turns counterclockwise.

8. A vehicle as set forth in claim 7, wherein said one-way drive mechanism is constituted by an annular ratchet having inner and outer teeth, said ratchet being coupled to the inner end of the spiral spring, and a drum mounted on the pinion shaft and having a projecting pin engaging the inner teeth of the ratchet to cause it to rotate in the counterclockwise direction.

9. A vehicle as set forth in claim 8, further including a pawl engaging the outer teeth of the ratchet to prevent it from rotating in the clockwise direction.

10. A vehicle as set forth in claim 4, wherein said box is provided with front and rear projections, the front projection being received under the top ledge of an upright integral with the floor of the chassis, the rear projection being received within a slot in the rear wall of the chassis.

* * * * *